US011161638B2

(12) United States Patent
Bradley

(10) Patent No.: US 11,161,638 B2
(45) Date of Patent: Nov. 2, 2021

(54) AUTOMATIC SLEEVING MACHINE HOPPER

(71) Applicant: Keymac Packaging Systems Limited, Keynsham (GB)

(72) Inventor: Mike Bradley, Bristol (GB)

(73) Assignee: Keymac Packaging Systems Limited, Keynsham (GB)

( * ) Notice: Subject to any disclaimer, the term of this patent is extended or adjusted under 35 U.S.C. 154(b) by 282 days.

(21) Appl. No.: 15/614,099

(22) Filed: Jun. 5, 2017

(65) Prior Publication Data

US 2017/0349309 A1 Dec. 7, 2017

(30) Foreign Application Priority Data

Jun. 3, 2016 (GB) ..... 1609771

(51) Int. Cl.
*B65B 43/44* (2006.01)
*B65B 43/14* (2006.01)
*B65B 59/04* (2006.01)

(52) U.S. Cl.
CPC ..... *B65B 43/44* (2013.01); *B65B 43/145* (2013.01); *B65B 59/04* (2013.01)

(58) Field of Classification Search
USPC ..... 53/389
See application file for complete search history.

(56) References Cited

U.S. PATENT DOCUMENTS 1,688,510 A * 10/1928 Taylor ..... B65B 43/44 221/221
2,757,502 A 8/1956 Sunray
4,926,616 A * 5/1990 Zielke ..... B65B 25/002 53/169
4,991,705 A * 2/1991 Francioni ..... B65B 23/12 193/44
5,057,066 A * 10/1991 Nagahashi ..... B65B 43/145 493/122
5,449,061 A 9/1995 Wald
5,507,128 A 4/1996 Johnson
5,511,772 A * 4/1996 Ganz ..... B65B 43/185 271/108
5,588,643 A * 12/1996 Tagliaferri ..... B31B 50/00 271/10.07
6,309,335 B1 * 10/2001 Holton ..... B31B 50/00 493/120
6,699,165 B1 3/2004 Krieger
6,971,808 B2 * 12/2005 Dawson ..... B65H 1/04 271/145
2001/0004040 A1 * 6/2001 Martin ..... B65G 47/256 193/47

(Continued)

FOREIGN PATENT DOCUMENTS

BE 1012832 4/2001
DE 4012281 10/1991

(Continued)

*Primary Examiner* — Anna K Kinsaul
*Assistant Examiner* — Chinyere J Rushing-Tucker
(74) *Attorney, Agent, or Firm* — Lightbulb IP, LLC

(57) ABSTRACT

A packaging machine hopper is provided for holding a stack of packaging articles with each article in a generally horizontal orientation. The hopper comprises a support for holding at least part of the stack at an angle to vertical.

13 Claims, 5 Drawing Sheets

(56) References Cited

U.S. PATENT DOCUMENTS

| | | | | |
|---|---|---|---|---|
| 2002/0158400 | A1* | 10/2002 | Focke | B65B 19/228 271/4.06 |
| 2004/0114983 | A1* | 6/2004 | Dawson | B65H 1/04 400/624 |
| 2006/0065718 | A1 | 3/2006 | Tsuruta | |
| 2007/0001363 | A1* | 1/2007 | Flagg | B65B 43/185 271/3.01 |
| 2007/0104564 | A1* | 5/2007 | Covarrubias | B65G 59/106 414/795.4 |
| 2008/0075573 | A1 | 3/2008 | Rothbauer | |
| 2008/0210518 | A1* | 9/2008 | Bershadsky | B65G 47/26 198/459.1 |
| 2009/0038274 | A1* | 2/2009 | Cash, III | B65B 5/106 53/493 |
| 2015/0063974 | A1* | 3/2015 | Malenke | B65B 43/185 414/797.8 |
| 2016/0031661 | A1* | 2/2016 | Hiyama | B65H 5/068 271/165 |
| 2016/0137434 | A1* | 5/2016 | Bieringer | B65G 59/06 414/795.6 |

FOREIGN PATENT DOCUMENTS

| | | |
|---|---|---|
| DE | 4435981 | 4/1996 |
| DE | 202004015190 | 12/2004 |
| EP | 2974986 | 1/2016 |
| GB | 2075955 | 11/1981 |
| GB | 2393953 | 4/2004 |
| JP | S5472194 | 6/1979 |
| JP | S6299504 | 6/1987 |
| JP | 2010126307 | 6/2010 |
| KR | 2020120004484 | 6/2002 |
| KR | 20120004484 | 6/2012 |
| SU | 1421622 | 9/1988 |
| SU | 1518203 | 10/1989 |

* cited by examiner

AUTOMATIC SLEEVING MACHINE HOPPER

The present invention relates generally to a machine for automatically placing a packaging article, such as a sleeve or carton, around a pack.

There are many circumstances in which a final product is placed in a sleeve; for example food packs such as trays, cartons and the like. Machines for automating the process of placing the product in the sleeve (or the sleeve around the product) are known.

An aspect of the present invention provides a packaging machine hopper for holding a stack of packaging articles (for example with each article in a generally horizontal or flat orientation), the hopper comprising a support for holding at least part of the stack at an angle to vertical.

The hopper support may hold at least part of the stack at an angle in the range 40 degrees to 50 degrees; for example the hopper support may holds at least part of the stack at approximately 45 degrees.

In some embodiments the hopper support includes an inclined section and generally vertical terminal section.

The support may comprise a plurality of hopper rods, bars or the like defining a channel for receiving sleeves.

The hopper rods may include an inclined portion and terminal cranked portion.

The hopper may comprise a removable support plate, with the support carried on or by the plate.

A low-level alert function may be provided.

The present invention also provides a packaging machine having a hopper as described herein. The hopper may be filled with a plurality of cartons or sleeves.

The present invention also provides a sleeving machine having a hopper as described herein.

Some aspects and embodiments of the invention are configured for use with a 4, 5 or 6 panel packaging sleeve. The sleeves may be generally flat or planar.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combinations other than those explicitly set out in the claims.

The present invention will now be more particularly described, by way of example, with reference to the accompanying drawings, in which.

Figure 1:
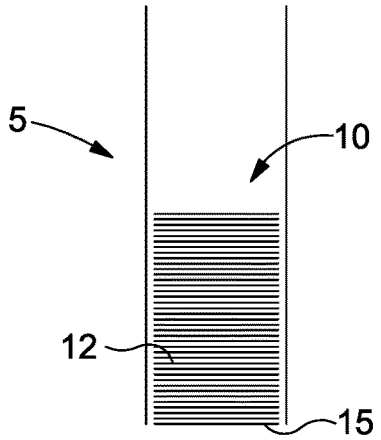
FIG. 1 illustrates a known vertical hopper for holding a stack of packaging sleeves.

The example embodiments are described in sufficient detail to enable those of ordinary skill in the art to embody and implement the systems and processes herein described.

It is important to understand that embodiments can be provided in many alternate forms and should not be construed as limited to the examples set forth herein.

Accordingly, while embodiment can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

In the following description, all orientational terms, such as upper, lower, radially and axially, are used in relation to the drawings and should not be interpreted as limiting on the invention.

Vertical hoppers 5 (see FIG. 1) are known for holding a stack 10 of sleeves 12. These hoppers are prone to allowing sleeves/cartons to fall through because of the weight and high pressure on the front sleeve or carton 15 and the direction in which gravity works.

Figure 2:
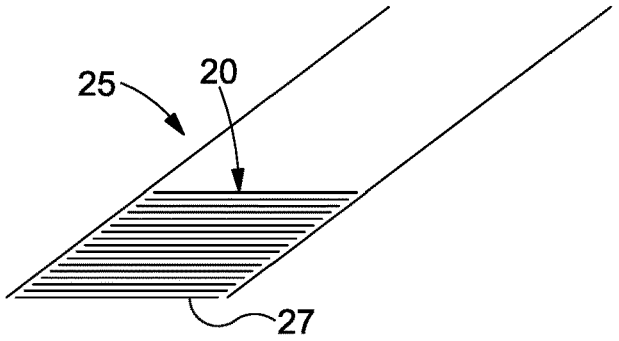
FIG. 2 shows a hopper formed in accordance with an embodiment of the present invention.

Referring to FIG. 2, the principle of the hopper 25 of the present invention eliminates that pressure by offsetting the stack 20 (e.g. leaning it "backwards") on a 45-degree angle. Because the weight on the front sleeve 27 is reduced (because the load is taken by the hopper) there is a reduced chance of a double feed. In addition, the sleeves are "shingled" i.e. they are laterally offset from each other, which helps to separate them and ensure that only one sleeve is fed at a time from the terminal end of the hopper. Leaning the support backwards has also been found to improve access in use.

Figure 3:
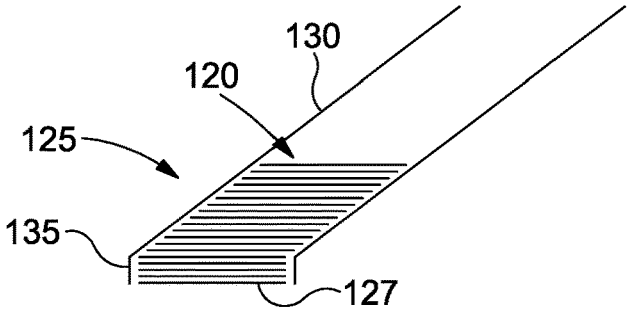
FIG. 3 shows a hopper formed according to a further embodiment.
Figure 4:
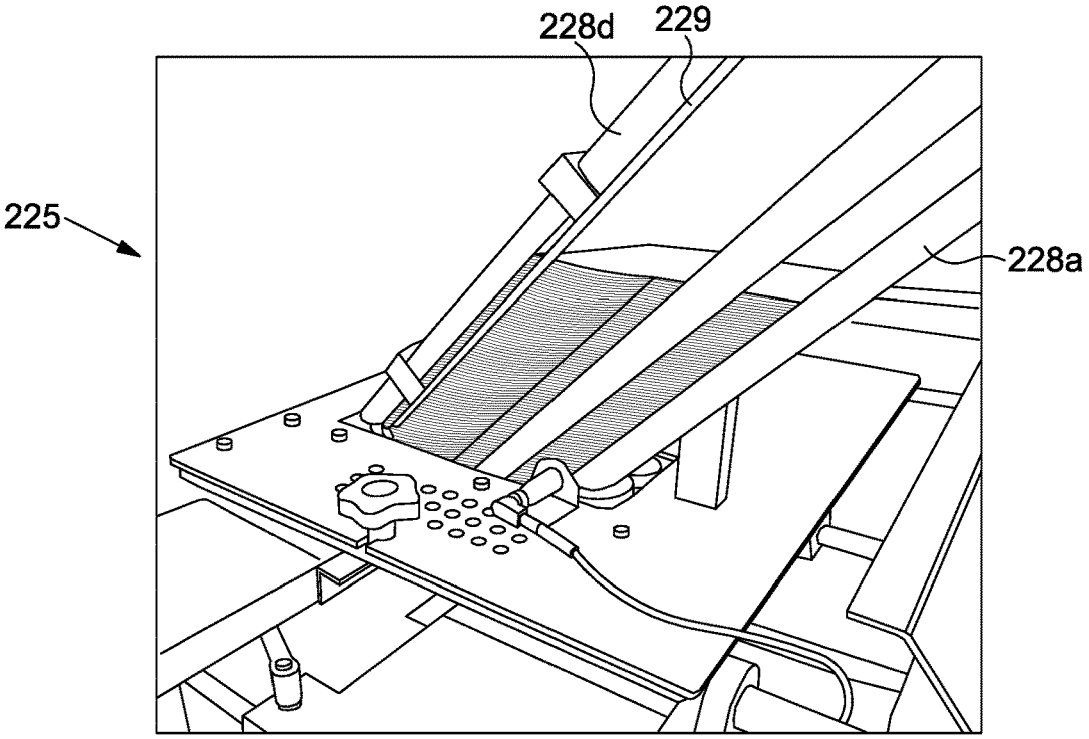
FIG. 4 is a rear side view of a hopper formed according to a further embodiment.
Figure 5:
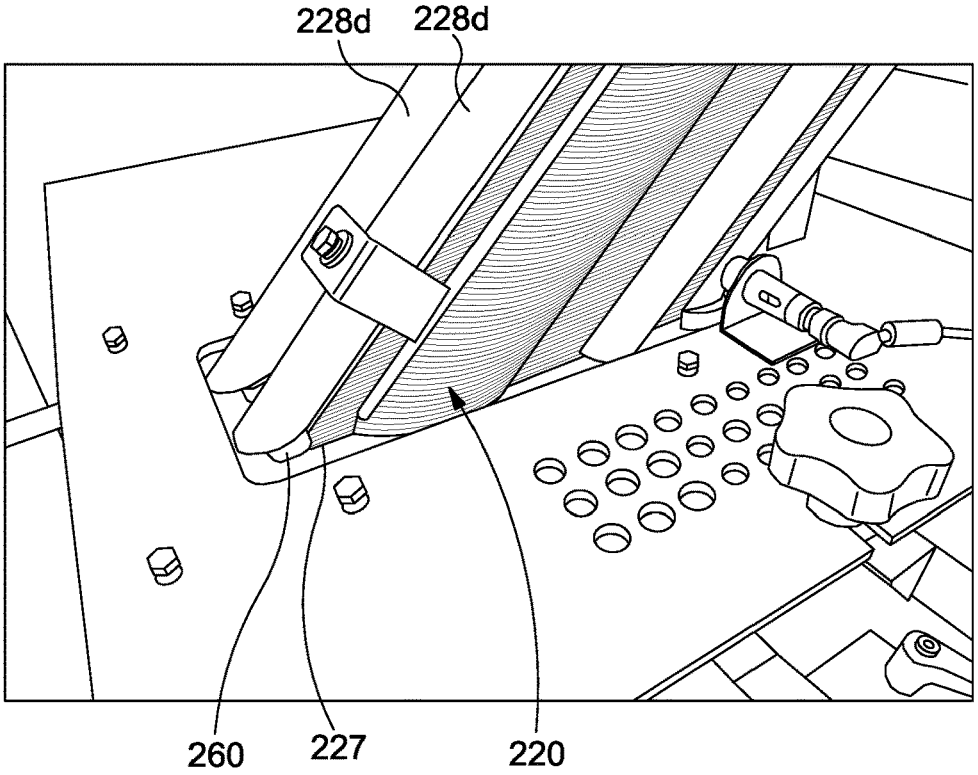
FIG. 5 is a front side view of the hopper of FIG. 4.
Figure 6:
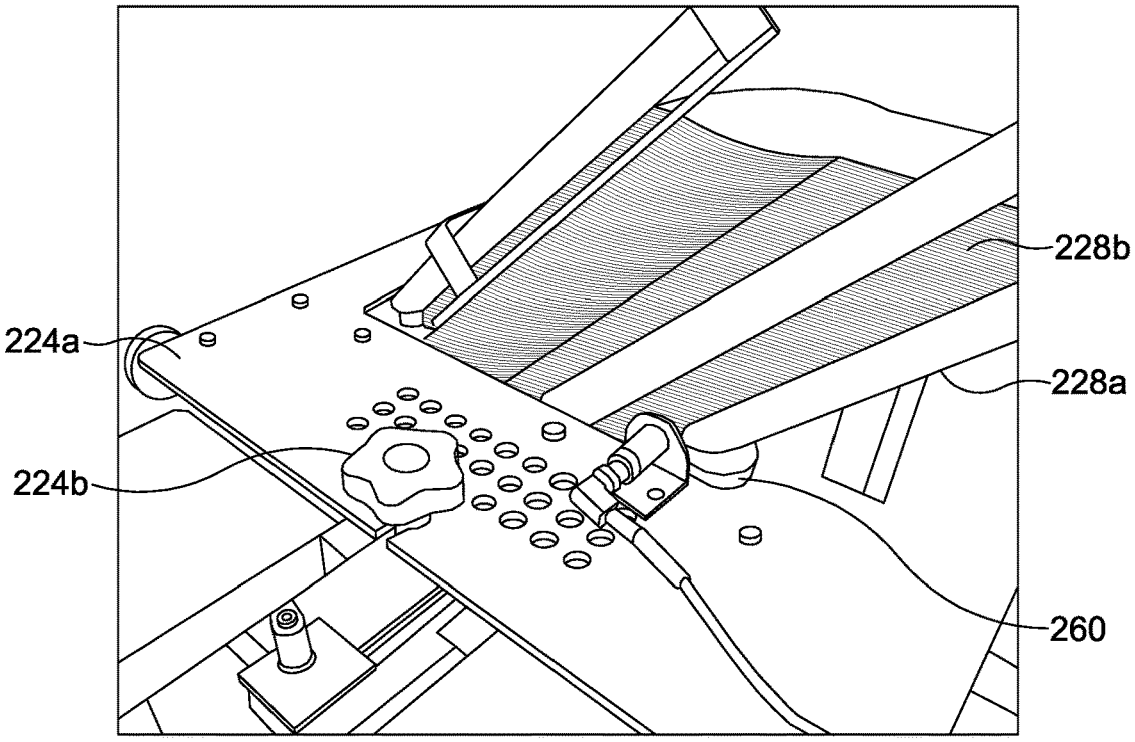
FIG. 6 is a further rear side view of the hopper of FIG. 4.
Figure 7:
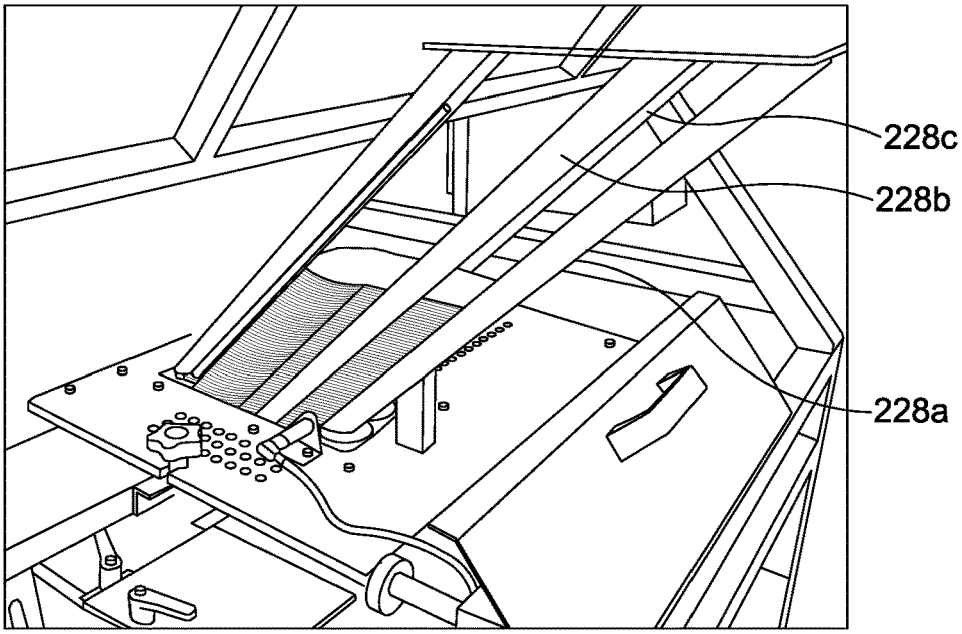
FIG. 7 is a further rear side view of the hopper of FIG. 4.

In FIG. 3 the hopper 125 includes an inclined section 130 and a vertical terminal section 135. This means that the majority of the stack 120 leans (providing the pressure elimination and separating benefits) but the final few (for example 10 mm) of the stack is vertical, making it easier for the final sleeve 127 to be picked.

In use a stack of sleeves (for example flat, pre-glued sleeves) is loaded into the hopper from the "top". An associated packaging machine can then take sleeves from the "bottom" of the stack i.e. the first sleeve in the stack.

In the embodiment of FIGS. 4 to 7 the hopper 225 includes a hopper support comprising a series of inclined straight bars: a single, central rear bar 228*a*; a pair of side bars 228*b*, 228*c*, and a pair of front bars 228*d*, 228*e*. A guide bar 229 is also connected to the bar 228*d*.

The hopper 225 includes a plate 224*a* which carries the bars. The plate 224*a* is removably secured to the machine by a nut 224*b*, and is removable from the rest of the machine so that the hopper can be removed and easily replaced with a different hopper (e.g. for different types of sleeves).

In this embodiment a short section of sleeves at the bottom of the stack 220 are substantially vertical. This is achieved by providing a spacer block 260 at the base of each bar, which effectively provides a cranked lower/terminal portion. This is a key feature to keeping the front sleeve 227 in registration and stops sideways movement when feeding.

The orientation of the carton/sleeve hopper 225 also allows better access from the side of the machine for sleeve loading.

The hopper 225 also keeps the sleeve in the same orientation through the entire sleeving operation without needing to rotate it through angles as it would be with a rotary feeder.

Figure 8:
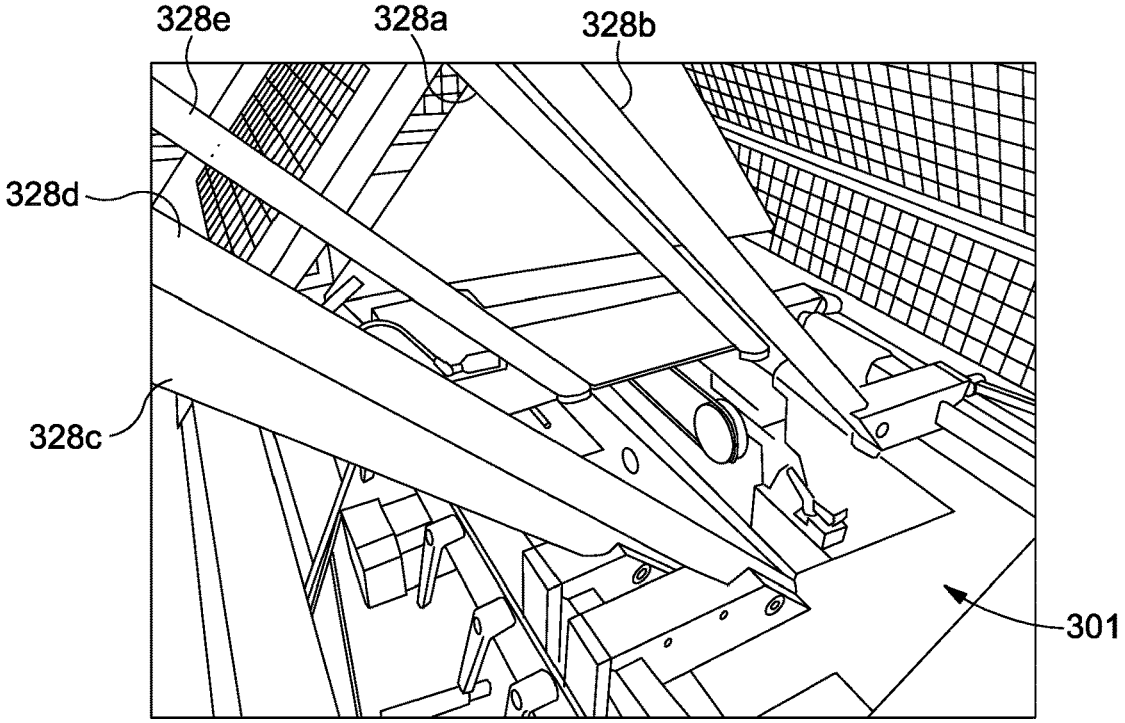
FIG. 8 shows a hopper formed in accordance with a further embodiment.
Figure 9:
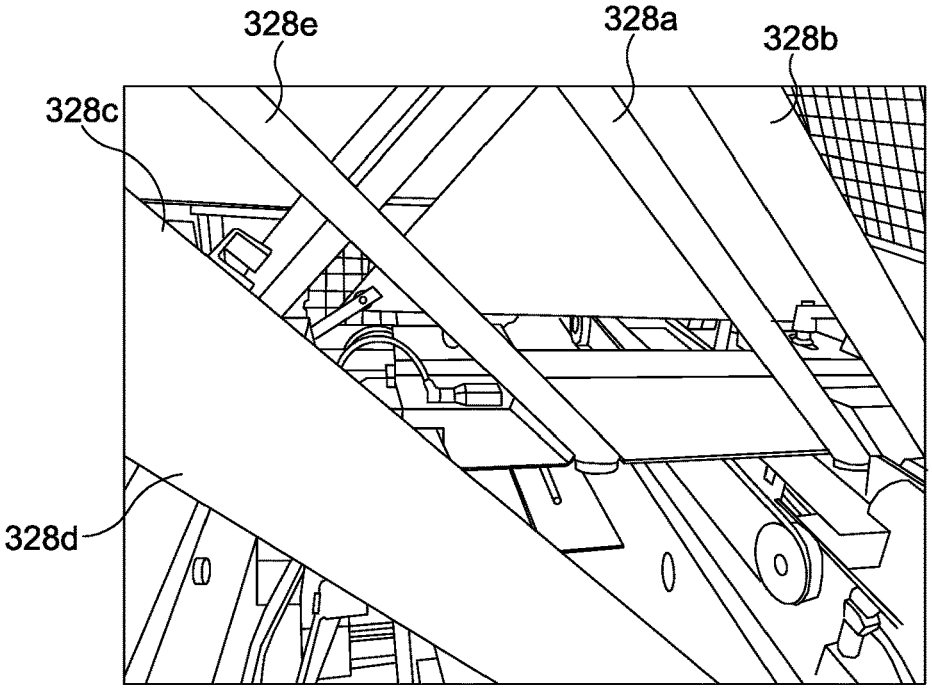
FIG. 9 is a side view of the hopper of FIG. 8.
Figure 10:
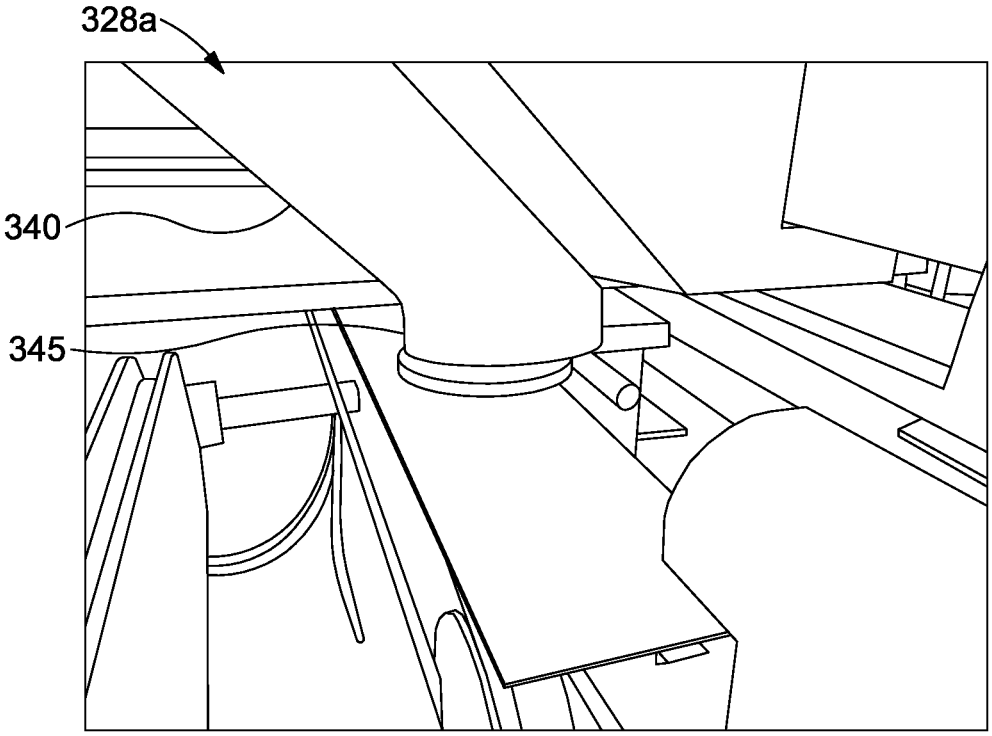
FIG. 10 is a magnified view of the lower end of the hopper of FIG. 9.

FIGS. 8 to 10 show a hopper 325 formed according to a further embodiment. The hopper 325 comprises five supports rods 328*a-e* arranged and configured to form a channel for receiving a stack of sleeves, cartons or the like for feeding into a packaging machine 301. As shown best in FIG. 10, each of the bars includes an inclined section 340 and a terminal, vertical section 345 with a cranked section giving an elbow like terminal portion.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention.

The invention claimed is:

1. A packaging machine comprising a hopper for holding and feeding a stack of packaging sleeves, the hopper having a top, from which the stack of sleeves is loadable into the hopper, and a terminal end, from which sleeves of the loaded stack of sleeves are fed, the hopper comprising a sleeve support for holding and feeding the stack of sleeves; the sleeve support including an inclined section and a generally vertical terminal section that meet at an angle in a plane from which the general vertical terminal section extends generally perpendicularly and from which the inclined section extends at a non-perpendicular angle, the generally vertical terminal section extending, in a longitudinal direction of the generally vertical terminal section, a shorter distance from the plane than the inclined section extends, in a longitudinal direction of the inclined section, from the plane, and the inclined section of the sleeve support defined by surfaces that are straight and extend from the plane at said non-perpendicular angle, and the generally vertical terminal section of the sleeve support defined by surfaces that are straight and extend generally perpendicularly from said plane;

the hopper further comprising a support plate on or by which the sleeve support is carried, the hopper removably secured to the packaging machine by the support plate being removably secured to the packaging machine, wherein removing said support plate from the packaging machine removes the hopper from the packaging machine, and wherein, when the support plate is secured to the packaging machine, the plane is generally horizontal, the generally vertical terminal section extends generally vertically, the inclined section extends at said angle to vertical, and the generally vertical terminal section is downstream of the inclined section;

whereby, in use, the hopper holds the sleeves of the stack of sleeves in a generally horizontal orientation between loading into, and feeding from, the hopper, with the sleeves in the inclined section being held in a generally horizontal orientation and laterally offset from each other and the sleeves in the generally vertical terminal section being held in a generally horizontal orientation and laterally aligned with each other.

2. The packaging machine of claim 1, in which said angle to vertical is in the range 40 degrees to 50 degrees.

3. The packaging machine of claim 2, in which said angle to vertical is approximately 45 degrees.

4. The packaging machine of claim 1, in which the hopper support comprises a plurality of hopper rods defining a channel for receiving sleeves of the stack of sleeves.

5. The packaging machine of claim 4, in which the hopper rods are inclined, straight bars that provide the inclined section, and the generally vertical terminal section is provided by spacer elements.

6. The packaging machine of claim 4, in which the hopper rods include an inclined portion that provide the inclined section and a terminal cranked portion that provide the generally vertical terminal section.

7. The packaging machine of claim 4, in which the hopper has a front and a rear, and the plurality of hopper rods comprises a single central rear bar, a pair of side bars, and a pair of front bars.

8. The packaging machine of claim 7, in which the hopper rods are inclined, straight bars that provide the inclined section, and the generally vertical terminal section is provided by spacer elements, and in which the hopper support further includes a guide bar connected to one of the pair of front bars.

9. The packaging machine of claim 1, comprising a low level alert.

10. The packaging machine of claim 1, in which the generally vertical terminal section has a depth in the longitudinal direction of the generally vertical terminal section of approximately 10 mm.

11. The packaging machine of claim 1, in which the top of the hopper is provided by the inclined section.

12. The packaging machine of claim 1, in which the hopper is loaded with a stack of sleeves.

13. The packaging machine of claim 12, in which the sleeves are 4, 5, or 6 panel packaging sleeves.

* * * * *